US012276001B2

(12) United States Patent
Sombra et al.

(10) Patent No.: US 12,276,001 B2
(45) Date of Patent: Apr. 15, 2025

(54) PROCESS FOR PREPARATION AND USE OF INORGANIC MARKERS FOR SECURITY IDENTIFICATION/MARKING ON EXPLOSIVES, FUSES AND AMMUNITION AFTER DETONATION AND ON FIREARMS AND METAL PROJECTILES, PRODUCTS OBTAINED AND PROCESS OF INSERTING MARKERS ON EXPLOSIVES, FUSES AND AMMUNITION AND ON FIREARMS AND METAL PROJECTILES

(71) Applicant: META—SOLUÇÕES EM SEGURANÇA LTDA., Morungaba (BR)

(72) Inventors: Antonio Sergio Bezerra Sombra, Fortaleza (BR); Sheila Nogueira Rebouças, São Paulo (BR)

(73) Assignee: META—SOLUÇÕES EM SEGURANÇA LTDA., Morungaba (BR)

( * ) Notice: Subject to any disclaimer, the term of this patent is extended or adjusted under 35 U.S.C. 154(b) by 332 days.

(21) Appl. No.: 17/986,049

(22) Filed: Nov. 14, 2022

(65) Prior Publication Data

US 2023/0257837 A1 Aug. 17, 2023

Related U.S. Application Data

(63) Continuation-in-part of application No. 17/265,688, filed as application No. PCT/BR2018/050274 on Aug. 3, 2018, now Pat. No. 11,499,217.

(51) Int. Cl.
*C21B 3/02* (2006.01)
*F42B 33/00* (2006.01)

(52) U.S. Cl.
CPC ..... *C21B 3/02* (2013.01); *F42B 33/00* (2013.01)

(58) Field of Classification Search
CPC ..... C21B 3/02; F42B 33/00
See application file for complete search history.

(56) References Cited

U.S. PATENT DOCUMENTS 9,500,457 B1 11/2016 Horch et al.

FOREIGN PATENT DOCUMENTS

WO 2010105326 A1 9/2010

OTHER PUBLICATIONS

Notice of Allowance issued on Feb. 1, 2022, in connection with corresponding Brazilian Application No. BR112021001378-4 (6 pp., including machine-generated English translation).
Office Action (with English Translation) issued on Oct. 26, 2021 and Response (with English Translation) filed on Dec. 23, 2021, in connection with corresponding Brazilian Application No. BR112021001378-4; 36 pages.
Hearns et al., "Preparation of a Ytterbium-tagged Gunshot Residue Standard for Quality Control in the Forensic Analysis of GSR"; Journal of forensic sciences; 2015; vol. 60, No. 3, pp. 737-742.

*Primary Examiner* — Jessee R Roe
(74) *Attorney, Agent, or Firm* — Maier & Maier, PLLC

(57) ABSTRACT

With respect to an unprecedented process of preparation of inorganic fluorescent markers under the action of infrared light, for identification and marking, by a specific insertion process, in explosives, fuses, ammunition after detonation, as well as the identification and marking of steel and metal alloys of firearms and metal projectiles an improvement includes the physical insertion of the markers in the channel and in the crucible of the pig iron production process; in this improved process, marking was carried out in the ratio of 1 part of the marker to 1,325,750 parts per mass of pig iron.

1 Claim, 4 Drawing Sheets

PROCESS FOR PREPARATION AND USE OF INORGANIC MARKERS FOR SECURITY IDENTIFICATION/MARKING ON EXPLOSIVES, FUSES AND AMMUNITION AFTER DETONATION AND ON FIREARMS AND METAL PROJECTILES, PRODUCTS OBTAINED AND PROCESS OF INSERTING MARKERS ON EXPLOSIVES, FUSES AND AMMUNITION AND ON FIREARMS AND METAL PROJECTILES

CROSS-REFERENCE TO RELATED APPLICATIONS

This application is a continuation in part of U.S. patent application Ser. No. 17/265,688, now U.S. U.S. Pat. No. 11,499,217, filed Feb. 3, 2021, which claims priority to and the benefit of International Patent Application No. PCT/BR2018/050274, filed Aug. 3, 2018, the entire contents of which are incorporated herein by reference.

FIELD

Addition of Invention of BR 11 2021 001378 4, filed on Aug. 3, 2018, assigning it a technological improvement, with novel and particular characteristics, in addition to those presented in the original application.

BACKGROUND

The international production of pig iron and consequently steel has suffered from the excessive emission of $CO_2$ and harming the environment. Modern companies have sought ways to use renewable energies to produce pig iron in a sustainable way.

SUMMARY

It turns out that there is a need to specifically distinguish and identify this sustainable iron to control its flow in the production chain and avoid being alleged by other producers to use sustainable iron that is not actually produced with this methodology.

The document refers to the process of preparing fluorescent inorganic markers under the action of infrared light, for identification and marking, by means of a specific insertion process, on explosives, fuses, ammunition after detonation, as well as the identification and marking of steel and metal alloys of firearms and metal projectiles.

More particularly, BR 11 2021 001378 4 is a process of preparing a group of materials, based on different inorganic matrices doped with rare earth ions, that demonstrate distinct colors in the visible region when they are excited with laser in the infrared region. Markers may be used to indicate the origin of explosives, fuses and ammunition and thus serve as a safety marking, indicating the origin of these hazardous products even after detonation. The same markers can be used to mark steel and its alloys with application in firearms and metal projectiles. The same inorganic marker is inserted in different ways in the explosive, in the ammunition and in the steel of the weapon or cartridge, in the last ones (steel of the weapon or cartridge) it can be by cementation or forging.

However, to perform the tests with explosives, the marker was inserted into the emulsion (mass of 110 g), cartridge, dynamite banana or the like. In the ammunition, the inorganic marker was mechanically mixed with the gunpowder, and it was detonated inside polyethylene and metal casings. It was also introduced into gunpowder used in ammunition for use in 38 caliber revolvers and in 380 caliber pistols.

Given the above, improvements in the project were developed to improve the process of BR 11 2021 001378 4, entitled PROCESS FOR PREPARATION AND USE OF INORGANIC MARKERS FOR SECURITY IDENTIFICATION/MARKING ON EXPLOSIVES, FUSES AND AMMUNITION AFTER DETONATION AND ON FIREARMS AND METAL PROJECTILES, PRODUCTS OBTAINED AND PROCESS OF INSERTING MARKERS ON EXPLOSIVES, FUSES AND AMMUNITION AND ON FIREARMS AND METAL PROJECTILES, by changing the materials with visible color generation capacity when excited in the infrared region, which can be used to determine the origin of explosives, fuses and ammunition, even after detonation, as well as in metallic weapons and projectiles, which are prepared using the solid-state reaction method, in which the inorganic oxides were mixed according to the desired stoichiometric proportions to obtain $LaNbO_4$ (Mark 1), $BiVO_4$, $Sr3V2O_8$ and $YNbO_4$ (Mark 2), respectively doped with rare-earth ions erbium and ytterbium, holmium and ytterbium, holmium and ytterbium and thulium and ytterbium, which are mechanically inserted into explosives and ammunition and by cementation and forging in metallic weapons and projectiles.

Still, the process of BR 11 2021 001378 4, consists of having the physical insertion of 1 part of marker for 1500 parts per mass of explosive emulsion.

Thus, the improvement introduced in the BR 11 2021 001378 4 system consists of the physical insertion of the markers in the channel and in the crucible of the pig iron production process; in this improved process, the marking was carried out in the order of 1 part of the marker for 1,325,750 parts per mass of pig iron.

Thus, the improvement is based on results of pig iron marking tests, which showed that the markers registered in patent BR 11 2021 001378 4 can be used in the marking of this material, since it was possible to observe during the tests the colors green (Mark 1) and blue (Mark 2) when the pig iron samples were excited with infrared. These colors are characteristic of the aforementioned markers and can only be observed when the tagged material is excited with specific wavelength infrared, which prevents counterfeiting and can be used for traceability of the tagged product.

It is worth noting that the methodology for applying the markers did not cause any change in the production system, productivity or quality of the pig iron that was marked, and the dilution used reached less than 1 part per million. Thus, it is clear that the markers can be used in the marking and identification of the pig iron.

BRIEF DESCRIPTION OF THE DRAWINGS

To assist in the understanding, the following figures are attached.

DETAILED DESCRIPTION OF THE EMBODIMENTS

Figure 1:
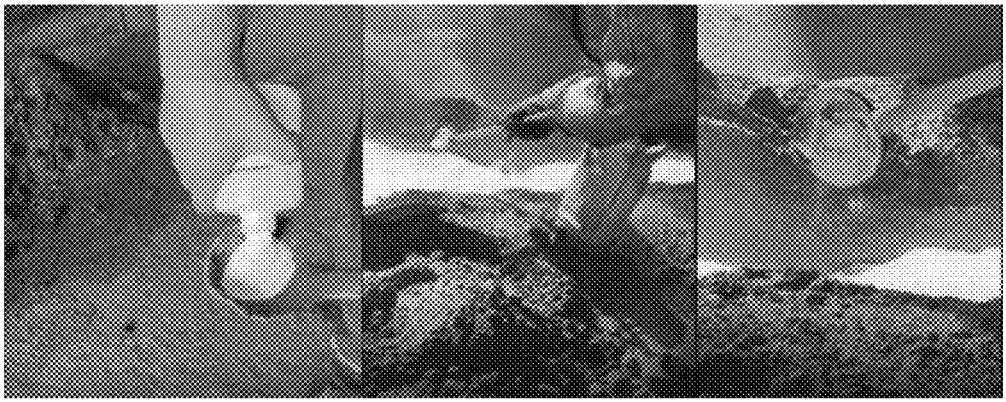
FIG. 1: shows the view of the marker insertion process in the pig iron batch, where the addition of the marker occurred directly in the channel and in the crucible, which shows that the insertion of the marker practically does not cause modification in the pig iron production process.
Figure 2:
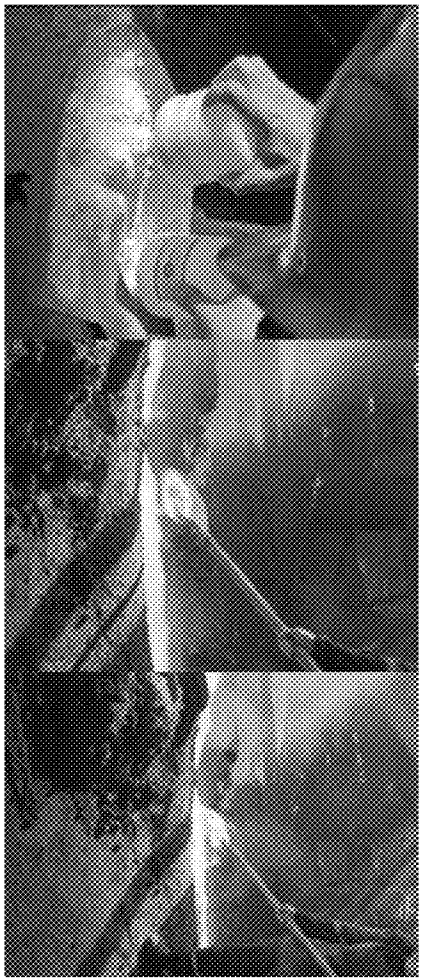
FIG. 2: view of the collection sample in the marked pig iron crucible; after marking different pig iron batches, samples were removed that were tested to later confirm whether it would be possible to observe the presence of a marker.
Figure 3:
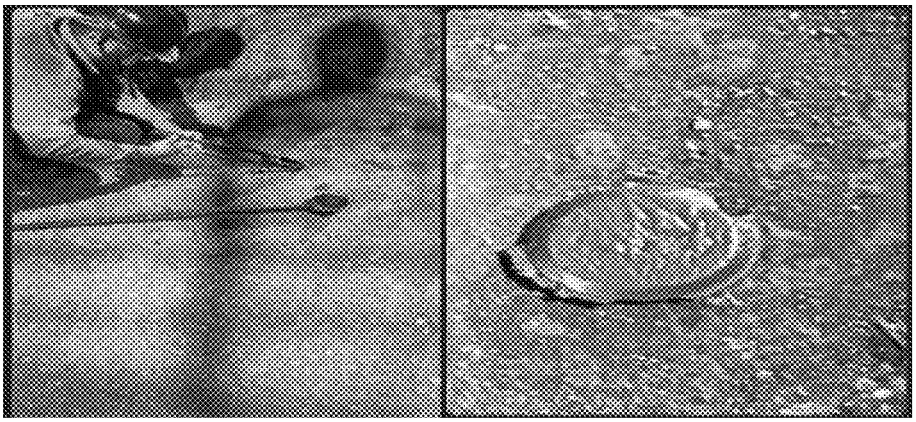
FIG. 3: shows the view of the verification tests of the marking on the pig iron sample in the ratio of 1 part of marker to 1,325,750 parts per mass of pig iron; said test was done using a laser pen, where the green color that is characteristic of the marker used in the tests was observed (Mark 1)
Figure 4:
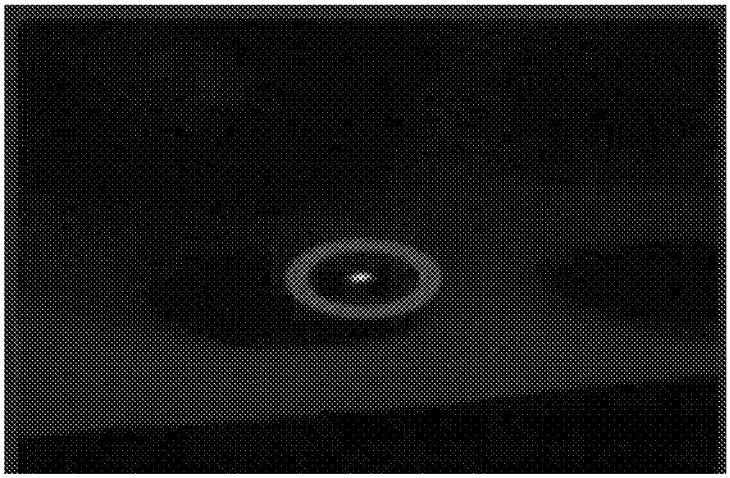
FIG. 4: shows the view of the marker spectrometry diagram, where the diagram of the upconversion fluorescence spectrum using benchtop laser in the range of 450 to 600 nm, obtained for one of the marked pig iron samples compared to the pure Mark 1 spectrum; further showing that the emission profiles are practically the same, proving the presence of the marker in the pig iron sample.

The PROCESS FOR PREPARATION AND USE OF INORGANIC MARKERS FOR SECURITY IDENTIFICATION/MARKING ON EXPLOSIVES, FUSES AND AMMUNITION AFTER DETONATION AND ON FIREARMS AND METAL PROJECTILES, PRODUCTS OBTAINED AND PROCESS OF INSERTING MARKERS ON EXPLOSIVES, FUSES AND AMMUNITION AND ON FIREARMS AND METAL PROJECTILES object of this application for an addition of invention, refers to an improvement that is based on results of pig iron marking tests, which showed that the markers registered in patent BR 11 2021 001378 4 can be used in the marking of this material, since it was possible to observe during the tests the colors green (Mark 1) and blue (Mark 2) when the pig iron samples were excited with infrared.

These colors are characteristic of the aforementioned markers and can only be observed when the tagged material is excited with specific wavelength infrared, which prevents counterfeiting and can be used for traceability of the tagged product.

Therefore, the improvement carried out in BR 11 2021 001378 4 consists of the physical insertion of the markers in the channel and in the crucible of the pig iron production process; in this improved process, marking was carried out on the ratio of 1 part of marker to 1,325,750 parts per mass of pig iron.

It is worth noting that the methodology for applying the markers did not cause any change in the production system, productivity or quality of the pig iron that was marked, and the dilution used reached less than 1 part per million. Thus, it is clear that the markers can be used in the marking and identification of the pig iron.

The invention claimed is:

1. A method for preparation and use of inorganic markers for security identification and/or marking on explosives, fuses and ammunition after detonation and on firearms and metal projectiles, including products obtained and a process of inserting markers on explosives, fuses, ammunition, firearms and metal projectiles, comprising: materials capable of generating visible colors when excited in the infrared region, which are used to determine the origin of explosives, fuses and ammunition, even after detonation, as well as in weapons and metal projectiles, prepared using a solid-state reaction method in which the inorganic oxides are mixed according to the desired stoichiometric proportions to obtain LaNbO4 (Mark1), BiVO4, Sr3V208 and YNbO4 (Mark 2) that are respectively doped with rare-earth ions erbium and ytterbium, holmium and ytterbium, holmium and ytterbium and thulium and ytterbium, which are mechanically inserted in explosives and ammunition by cementation and forging in weapons and metal projectiles, having the physical insertion of the markers in the channel and in the crucible of the pig iron production process, further comprising physical insertion of marking in the ratio of 1 part of marker to 1,325,750 parts per mass of pig iron.

* * * * *